United States Patent [19]

Hartzell

[11] Patent Number: 4,607,553

[45] **Date of Patent: * Aug. 26, 1986**

[54] SELF-CLEARING PUNCH WITH REMOVABLE BLADE

[75] Inventor: John C. Hartzell, Trenton, Mich.

[73] Assignee: Hanger Hole Punches, Inc., South Lyon, Mich.

[ * ] Notice: The portion of the term of this patent subsequent to Jan. 22, 2002 has been disclaimed.

[21] Appl. No.: 635,510

[22] Filed: Jul. 30, 1984

Related U.S. Application Data

[63] Continuation-in-part of Ser. No. 496,614, May 20, 1983, Pat. No. 4,494,426.

[51] Int. Cl.[4] ..... B26F 1/14

[52] U.S. Cl. ..... 83/164; 83/165; 83/684; 83/698

[58] Field of Search ..... 83/97, 164, 165, 684–691, 83/652–659

[56] References Cited

U.S. PATENT DOCUMENTS

| | | | |
|---|---|---|---|
| 1,309,157 | 7/1919 | Stockman | 83/681 X |
| 1,718,476 | 6/1929 | Messmer, Jr. | 83/690 |
| 1,942,539 | 1/1934 | Deubel | 83/684 |
| 1,976,992 | 10/1934 | Hinds | 83/164 |
| 1,993,041 | 3/1935 | Singer | 83/164 |
| 2,087,186 | 7/1937 | Freeman, Jr. | 83/164 X |
| 2,187,651 | 1/1940 | Jackson | 83/97 X |

FOREIGN PATENT DOCUMENTS

| | | | |
|---|---|---|---|
| 725741 | 3/1955 | United Kingdom | 83/652 |

*Primary Examiner*—James M. Meister

*Attorney, Agent, or Firm*—Charles W. Chandler

[57] ABSTRACT

A punch is disclosed having a hollow removable blade for punching an opening in a sheet of cardboard or other similar material. The blade has a beveled cutting edge about an inlet end. The diameter of the blade increases from the inlet end to the outlet end to prevent the slugs from becoming compacted in the blade.

8 Claims, 5 Drawing Figures

SELF-CLEARING PUNCH WITH REMOVABLE BLADE

CROSS-REFERENCE TO RELATED APPLICATIONS

This application is a continuation-in-part application of U.S. application, Ser. No. 496,614, having a filing date of May 20, 1983, now U.S. Pat. No. 4,494,426.

BACKGROUND OF THE INVENTION

This invention is related to punches for cutting an opening in cardboard material, and more particularly to a punch of the type having a removable blade for cutting an elongated slot in cardboard or plastic material.

Display packaging of the type hung on an elongated wire support is punched with a slot for receiving the support. In my aforementioned patent application, a punch having a removable, replaceable blade was disclosed. One of the problems with this type of punch is that as the blade forms a slot in a series of blanks, the slugs tend to become compacted in the blade requiring additional force to push the slugs through the punch.

SUMMARY OF THE INVENTION

The broad purpose of the present invention is to provide an improved removable blade for a self-clearing punch in which the blade is formed of steel rule with a beveled cutting edge forming an inlet opening at one end of the blade. As pressure is applied on the beveled cutting edge against a cardboard blank, the blade cuts a slug which is received into the blade. The blade has a relieved section forming an enlarged passage for the slug as it progresses through the blade. This reduces the effort necessary to push the slug to the outlet opening, thereby obviating the problem of slugs becoming compacted in the blade.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
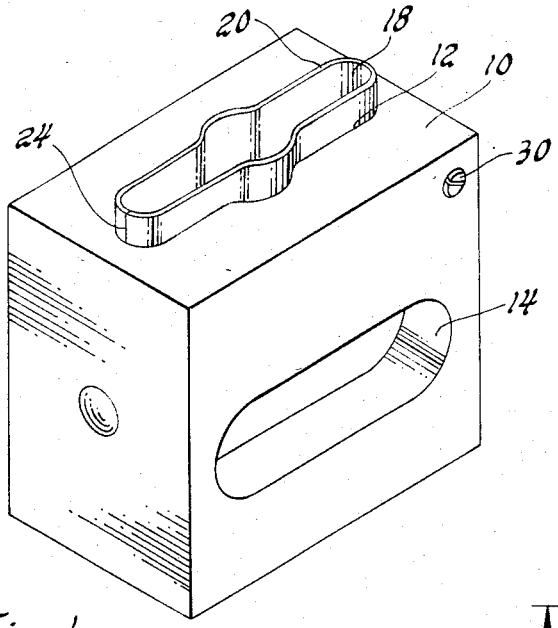
FIG. 1 is a perspective view of a punch having a removable blade illustrating the preferred embodiment of the invention.
Figure 2:
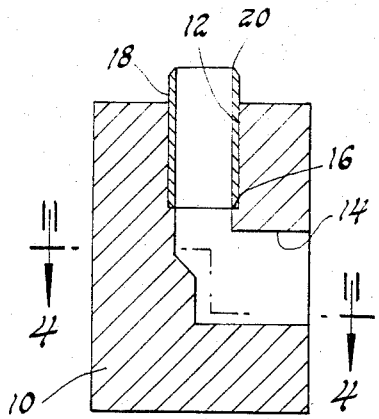
FIG. 2 is a sectional view through the punch of FIG. 1.

Referring to the drawing, FIG. 1 illustrates a self-clearing punch having a metal body 10. The punch has top opening 12 that extends downwardly and is connected to side opening 14. The body has an upper seat 16 between the top and the side openings. Cutting blade 18 is mounted in top opening 12. The cutting blade is preferably formed of steel rule, a relatively thin, carbon steel strip having its upper cutting edge beveled to form cutting edge 20. However, other hardenable steel can be used. The cutting edge has a cross-section corresponding to the shape of the slug being punched in cardboard blank 22. Although an elongated slot is disclosed as being cut, the opening can have any suitable shape. Preferably the ends of the steel rule are disposed adjacent one another at 24 to form a generally tubular configuration. The bottom of the blade is mounted on seat 16.

Figure 3:
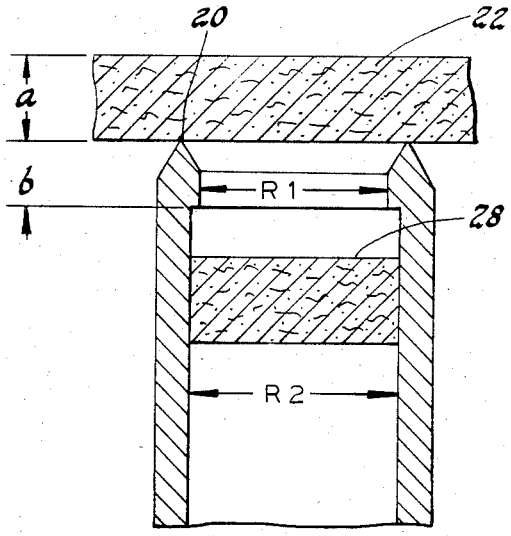
FIG. 3 is an enlarged fragmentary, sectional view of the blade.
Figure 4:
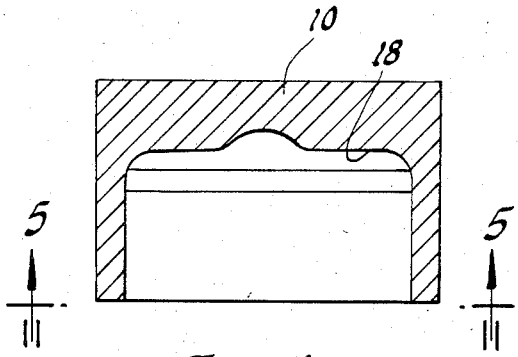
FIG. 4 is a view as seen along lines 4—4 of FIG. 2.
Figure 5:
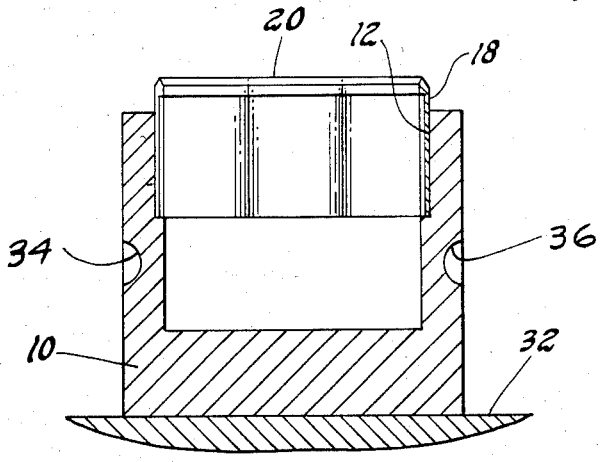
FIG. 5 is a view as seen along lines 5—5 of FIG. 4.

Referring to FIG. 3, cutting edge 20 defines the inlet end of the blade. The blade has a diameter, illustrated at R1 in FIG. 3, closely adjacent the beveled cutting edge. The blade has a greater diameter R2, a short distance in the direction of travel 26 of slug 28, so that the slug has a larger opening to pass from the inlet of the blade toward the outlet thereby preventing compacting.

Although FIG. 3 shows the width of the blade, it is to be understood that the enlarged diameter extends entirely around the interior of the blade passage through which the slug passes after it has been formed from cardboard blank 22. The enlarged diameter can be formed in the steel rule prior to bending it into the shape of the slug by grinding or other suitable means.

The distance "b" from the tip of the cutting edge to the edge of the relieved area defining the beginning of diameter R2, is shown as less than the thickness "a" of blank 22. Thus a portion of a newly cut slug extends into the enlarged section of the blade upon completion of a cutting motion. This prevents the slugs from backing up toward the blade inlet. The blade can also effectively cut material having a lesser thickness as long as at least a portion of the slug is received in the blade portion having diameter R1 so as to be held against backing toward the inlet opening. The next slug will then push the slug toward the larger diameter portion of the blade. Diameter R2 may be either greater or lesser than the distance between opposite sides of cutting edge 20.

Referring to FIG. 1, threaded fastener 30, mounted on the body, engages the blade to lock it to the body.

In use, the punch is mounted in the conventional manner in a die 32. A pair of recesses 34 and 36 provide means for receiving a fastener (not shown) to hold the punch in a fixed position with respect to the die. As pressure is applied on the blade against the cardboard blank, the cutting edge forms slug 28, which is received through the inlet opening of the blade. Each subsequent cutting motion produces an additional slug that causes the previous slugs to advance toward the outlet opening of the blade and the punch, so that the device has a basically self-clearing action.

Having described my invention, I claim:

1. A self-clearing punch for cutting a slug from a sheet of material, comprising:

a punch body having an opening;

a blade having a tubular wall having a beveled cutting edge with a cutting tip having a first diameter for cutting a slug of a first thickness such that the slug has a diameter generally corresponding to said first diameter;

the blade cutting edge being beveled from the tip of the edge such that the internal diameter of the blade adjacent the cutting edge is reduced to a second diameter, lesser than said first diameter;

the blade being internally relieved to a third diameter, greater than the second diameter, whereby as the slug is cut from the sheet material, the slug is diametrically compressed as it is received in the portion of the blade having the second diameter, the slug being suited to pass through the blade as the slug advances to the portion of the blade having the third diameter.

2. A punch as defined in claim 1, in which the punch body has a second opening for removal of slugs being received through the inlet opening of the blade.

3. A punch as defined in claim 1, in which the blade is formed of steel rule.

4. A punch as defined in claim 1, including fastener means mounted on the body for locking the blade to the body.

5. A combination as defined in claim 1, in which the tubular blade has a wall having an outside surface, and an inside surface adjacent the cutting edge and the diameter of the cutting tip is less than the diameter of the outside surface but greater than the diameter of the inside surface.

6. A combination as defined in claim 1, in which the distance from the tip of the cutting edge to the portion having said third diameter is less than the thickness of the slug.

7. A combination as defined in claim 1, in which the distance from the cutting edge to the portion of the blade having the second diameter is less than the first thickness of the slug.

8. A self-clearing punch for cutting a slug from a sheet of material, comprising:

a punch body having an opening;

a tubular blade having a cutting edge with a cutting tip having a first diameter for cutting a slug of a first thickness such that the slug has a diameter generally corresponding to said first diameter;

the blade cutting edge being internally beveled from the tip of the edge such that the blade has a first portion adjacent the cutting edge with an internal diameter reduced to a second diameter, lesser than said first diameter;

the blade having a second portion adjacent the first portion internally relieved to a third diameter, greater than the second diameter;

the cutting edge being externally beveled such that the diameter of the cutting tip is less than the diameter of the outside surface but greater than the diameter of the inside surface of the tubular wall;

the distance from the tip of the cutting edge to said first portion being less than the first thickness of the slug; and the distance from the top of the cutting edge to said first portion of the blade being less than the first thickness of the slug; and whereby as the slug is cut from the sheet material, the slug is diametrically compressed as it is received in the first portion of the blade having the second diameter, the slug being suited to pass through the blade as the slug advances to the second portion of the blade having the third diameter.

* * * * *